US009312623B2

(12) United States Patent
Takamura

(10) Patent No.: US 9,312,623 B2
(45) Date of Patent: Apr. 12, 2016

(54) CONNECTOR FOR ELECTRONIC DEVICE

(71) Applicant: Yazaki Corporation, Tokyo (JP)

(72) Inventor: Naoki Takamura, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/638,421

(22) Filed: Mar. 4, 2015

(65) Prior Publication Data

US 2015/0255908 A1 Sep. 10, 2015

(30) Foreign Application Priority Data

Mar. 7, 2014 (JP) ..... 2014-045266
Mar. 7, 2014 (JP) ..... 2014-045474

(51) Int. Cl.
*H01R 13/40* (2006.01)
*H01R 13/24* (2006.01)
*H01R 13/62* (2006.01)
*H01R 24/50* (2011.01)

(52) U.S. Cl.
CPC ..... *H01R 13/2407* (2013.01); *H01R 13/2414* (2013.01); *H01R 13/62* (2013.01); *H01R 24/50* (2013.01)

(58) Field of Classification Search
CPC ..... H01R 13/5208; H01R 13/5219
USPC ..... 439/587, 271, 620, 0.15, 76.1, 76.2
See application file for complete search history.

(56) References Cited

U.S. PATENT DOCUMENTS

2015/0255908 A1* 9/2015 Takamura ..... H01R 13/2414 439/370
2015/0340816 A1* 11/2015 Abe ..... H01R 13/42 439/607.34

FOREIGN PATENT DOCUMENTS

JP 2011-258422 A 12/2011

* cited by examiner

*Primary Examiner* — Phuongchi T Nguyen
(74) *Attorney, Agent, or Firm* — Sughrue Mion, PLLC

(57) ABSTRACT

A connector for an electronic device is provided. The connector includes a connector housing to be connected to the electronic device, a terminal fitting held by the connector housing, and a relay terminal to be held between a distal end of the terminal fitting and the contact portion of the electronic device when the connector housing is connected to the electronic device. The relay terminal includes an electrically-insulating member and an electrically-conductive portion. The electrically-conductive portion includes a conductor provided on the electrically-insulating member to electrically couple a contact portion of the electronic device and the terminal fitting to each other. The conductor extends in a direction intersecting a center axis of the connector in a state in which the conductor is in contact with at least one of the contact portion of the electronic device and the terminal fitting.

8 Claims, 8 Drawing Sheets

CONNECTOR FOR ELECTRONIC DEVICE

CROSS-REFERENCE TO RELATED APPLICATIONS

The present application claims priority from Japanese Patent Application Nos. 2014-045266 and 2014-045474 both filed on Mar. 7, 2014, the entire contents of which are incorporated herein by reference.

FIELD OF INVENTION

The present invention relates to a connector for an electronic device.

RELATED ART

FIG. 8 illustrates a related art connector 100 for an electric device 200. The connector 100 includes a connector housing 110 connected to one end 211 (the upper end in FIG. 8) of a housing 210 of the electronic device 200, and a linear conductor 120 which serves as a terminal fitting supported by the connector housing 110 (see, e.g., JP 2011-258422A).

In the electronic device 200, a circuit board 220 is mounted in an internal space of the housing 210 on a side of the end 211. In addition, a relay terminal 230 is mounted in an attachment hole 214 extending through a partition wall 213 on the end 211.

Although not shown, a first component is mounted on the other end 212 (the lower end in FIG. 8) of the housing 210 on a side opposite to the other end 211, and a second component is mounted on the circuit board 220 so as to be disposed coaxially with the first component.

The electronic device 200 is, for example, an in-vehicle camera, in which case the first component mounted on the end 212 of the housing 210 is a lens of the camera, and he second component mounted on the circuit board 220 coaxially with the first component is an image sensor configured to capture light incident thereon through the lens (the first component).

A contact portion 221 as an output terminal portion of the second component (e.g., the image sensor) is mounted on a surface of the circuit board 220 that faces a relay terminal 230.

The relay terminal 230 is held between the contact portion 221 and the linear conductor 120 and electrically couples the contact portion 221 and the linear conductor 120 to each other. The relay terminal 230 includes a columnar rubber 231 tightly fitted into the attachment hole 214, and a conductor component 232 which is embedded and mounted in the rubber 231. The conductor component 232 is an assembly of a large number of granular conductors 232*a*. The conductor component 232 is configured to be able to expand and to shrink in an axial direction (the direction Y1 in FIG. 8). Thus, the conductor component 232 can absorb an error of a distance between the linear conductor 120 and the contact portion 221 caused by an assembly error or the like.

In the electronic device 200, the circuit board 220 is fixed to the housing 210 rigidly by locking projections. Therefore, in order to surely bring the linear conductor 120 into contact with the contact portion 221 of the circuit board 220, it is necessary to position and connect the connector 100 with respect to the electronic device 200 accurately to thereby align the axial center of the connector 100 with the axial center of the electronic device 200. Accordingly, it is not easy to assemble the connector 100 and the electronic device 200.

SUMMARY

Illustrative aspects of the present invention provide a connector that does not require high accuracy in positioning its contact point with respect to a contact point of an electronic device.

According to an illustrative aspect of the present invention, a connector for an electronic device is provided. The connector includes a connector housing adapted to be connected to the electronic device, a terminal fitting held by the connector housing, the terminal fitting being electrically coupled to a contact portion of the electronic device when the connector housing is connected to the electronic device, and a relay terminal adapted to be held between a distal end of the terminal fitting and the contact portion of the electronic device when the connector housing is connected to the electronic device. The relay terminal includes an electrically-insulating member and an electrically-conductive portion. The electrically-conductive portion includes a conductor provided on the electrically-insulating member to electrically couple the contact portion of the electronic device and the terminal fitting to each other. The conductor extends in a direction intersecting a center axis of the connector in a state in which the conductor is in contact with at least one of the contact portion of the electronic device and the terminal fitting.

Other aspects and advantages of the invention will be apparent from the following description, the drawings and the claims.

DETAILED DESCRIPTION

Hereinafter, exemplary embodiments of the present invention will be described in detail with reference to the drawings. However, the following exemplary embodiments do not limit the scope of the claimed invention.

FIGS. 1 to 5 show an electronic device connector 30 according to an exemplary embodiment of the present invention.

Figure 1:
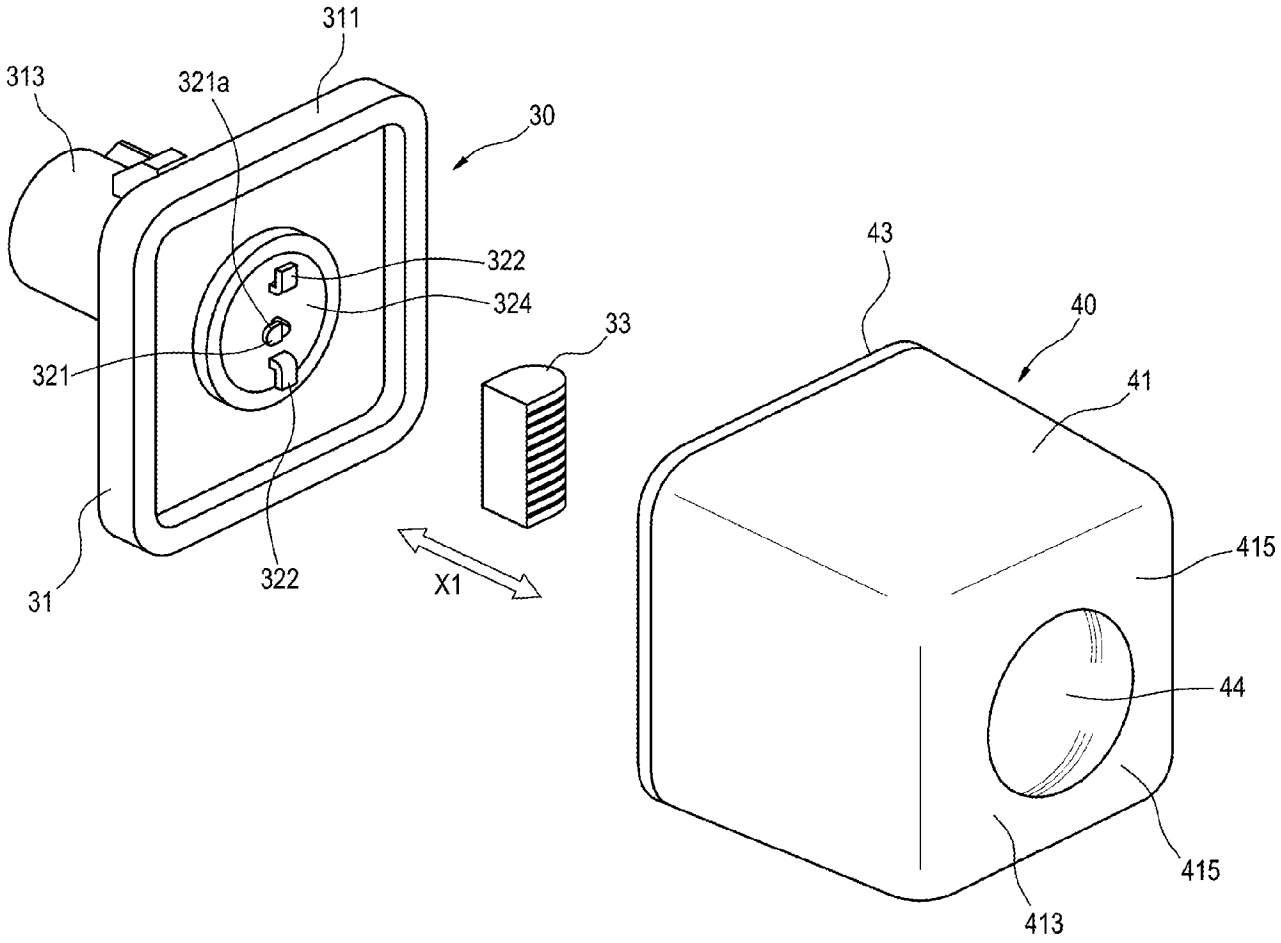
FIG. 1 is an exploded perspective view of a connector and an electronic device according to an exemplary embodiment of the invention.
Figure 2:
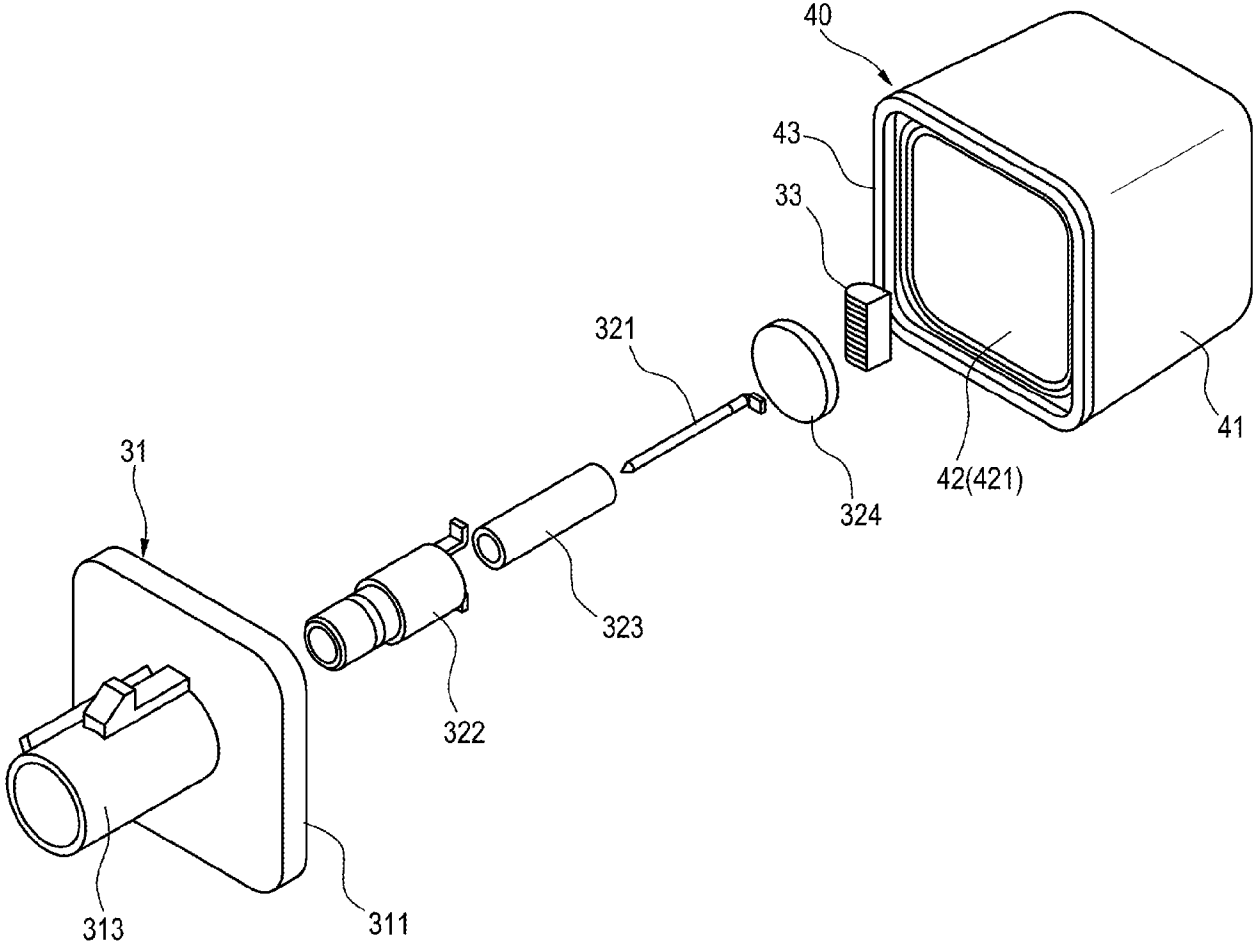
FIG. 2 is another exploded perspective view of the connector and the electronic device viewed from another angle.
Figure 3:
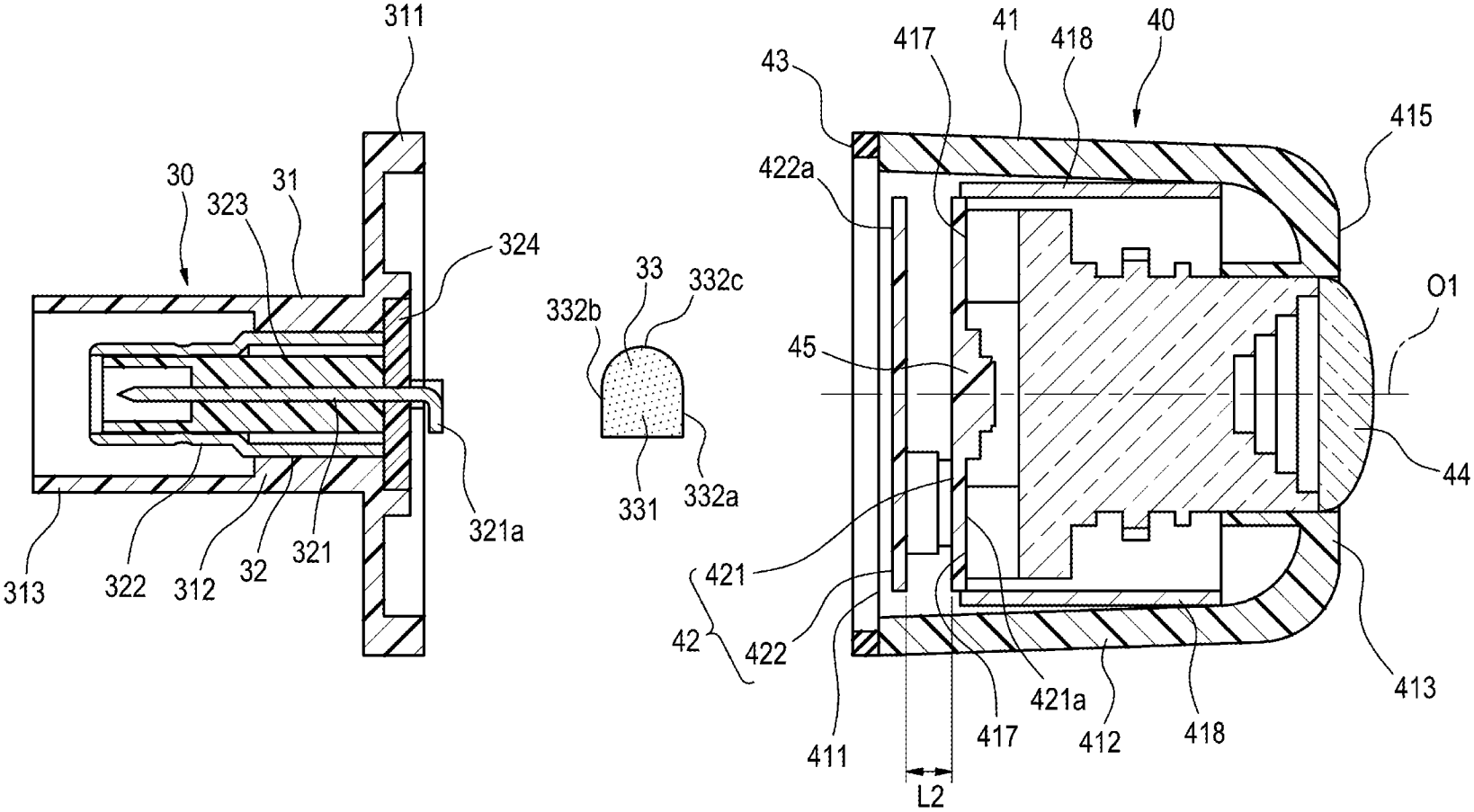
FIG. 3 is a vertical sectional view of the connector and the electronic device.

As shown in FIGS. 1 to 3, a connector 30 includes a connector housing 31 adapted to be connected to an end 411 (the left end in FIG. 3) of a housing 41 of an electronic device 40, a terminal fitting 32 held by the connector housing 31, and a relay terminal 33 which is mounted in a distal end of the terminal fitting 32. A seal packing 43 made of rubber is attached to the end 411 of the housing 41. The connector housing 31 is connected to the other end of the housing 41 through the seal packing 43 so as to be waterproofed.

Before describing the configuration of the connector 30 in detail, the configuration of the electronic device 40 will be described first.

The electronic device 40 shown in an exemplary embodiment has a circuit board 42 mounted in an internal space of the housing 41 on a side of the end 411.

As shown in FIG. 3, the housing 41 includes a peripheral wall portion 412 substantially shaped like a rectangular cylinder, and a front end wall portion 413 closing one side (the right side in FIG. 3) of the peripheral wall portion 412.

The end 411 of the housing 41 is an end portion of the peripheral wall portion 412 located on a side opposite to the front end wall portion 413. An outer end face of the front end wall portion 413 located on the side opposite to the end 411 serves as an end 415 of the housing 41.

In the case of the electronic device 40 according to the exemplary embodiment, the circuit board 42 includes two circuit boards 421, 422 which are spaced from each other in a longitudinal direction of a center axis O1 of the electronic device 40. The circuit boards 421, 422 are parallel to each other and assembled in the housing 41 in a direction in which surfaces of these two circuit boards 421, 422 are perpendicular to the center axis O1.

The circuit boards 421, 422 are connected to each other through a not-shown coupling unit so as to stand face to face with each other with a predetermined clearance L2. The circuit boards 421, 422 are assembled into one component in the housing 41.

As shown in FIG. 3, in the electronic device 40 according to the exemplary embodiment, a first component 44 is provided at the end 415 of the housing 41 and a second component 45 is mounted on the circuit board 421 located on a side of the end 415.

The electronic device 40 according to the exemplary embodiment is configured as an in-vehicle camera. The first component 44 is a lens. The second component 45 is an image sensor configured to convert light incident thereon through the lens into a video signal. Contact portions (not shown) serving as output terminal portions of the second component 45 are provided on an outer surface 422*a* (the surface facing the connector 30) of the circuit board 422 located on a side of the end 411 of the housing 41. The terminal fitting 32 of the connector 30, which will be described later, is electrically coupled to the contact portions of the outer surface 422*a* of the circuit board 422 so that the terminal fitting 32 can receive an output signal of the second component 45. The first component 44 and the circuit board 422 are surrounded by an electromagnetic shield member 418.

The first component 44 and the second component 45 of the electronic device 40 are arranged such that their center axes are aligned coaxially with each other.

According to this exemplary embodiment, a board reference surface 417 for positioning the circuit board 42 is provided in the housing 41. When the board reference surface 417 abuts against a component mounting face 421*a* of the circuit board 42 on which the second component 45 is mounted, the circuit board 42 is positioned so that the second component 45 can be disposed perpendicularly to the center axis (the optical axis) of the first component 44 and the center axis of the second component 45 can be aligned with the center axis of the first component 44. The board reference surface 417 serves as a second component reference surface to substantially position the second component.

That is, when the circuit board 42 is biased and pressed toward the end 415 of the housing 41, the board reference surface 417 of the housing 41 abuts against the component mounting face 421*a* of the circuit board 421. Thus, the circuit board 42 is positioned so that the center axis of the second component 45 can be aligned with the center axis of the first component 44.

In the case of the exemplary embodiment, the circuit board 42 is fixed to the housing 41 not rigidly by locking projections or the like but with a slight clearance so that the circuit board 42 can be made to abut against the board reference surface 417 by a pressing force acting on the circuit board 42 from the relay terminal 33 which will be described later. Thus, the circuit board 42 can be positioned in the housing 41.

Next, the configuration of the connector 30 will be described in detail. The connector housing 31 of the connector 30 is an integral molded article made of an insulating resin. The connector housing 31 includes a flange portion 311 connected to the end 411 of the housing 41, a terminal retaining portion 312 formed in a central portion of the flange portion 311, and a cylindrical cable receiving portion 313 extending rearward (leftward in FIG. 3) from the terminal retaining portion 312.

The flange portion 311 of the connector housing 31 is fixed to the end 411 of the housing 41 by a not-shown fastening or lock unit.

The cable receiving portion 313 is a portion where an end portion of a shield cable connected to the terminal fitting 32 is received.

As shown in FIG. 3, the terminal fitting 32 is a shield terminal including an internal conductor 321, an external conductor 322, and a dielectric 323. The internal conductor 321 is made of metal and electrically coupled to the not-shown contact portion on the circuit board 422. The external conductor 322 is shaped like a cylinder surrounding the outer circumference of the internal conductor 321. A gap between the internal conductor 321 and the external conductor 322 is filled with the dielectric 323. A shield braid etc. of a shield cable to be connected to the terminal fitting 32 is connected to the external conductor 322.

A distal end portion 321*a* of the internal conductor 321 is a portion which is electrically coupled to the contact portion on the circuit board 422. As shown in FIG. 3, the internal conductor 321 is fixed to the terminal retaining portion 312 by a silicon potting 324. The internal conductor 321 is fixed to the terminal retaining portion 312 in the state in which the distal end portion 321*a* of the internal conductor 321 protrudes from the surface of the flange portion 311. In addition, since the silicon potting 324 is applied, the terminal retaining portion 312 is waterproofed.

Figure 4:
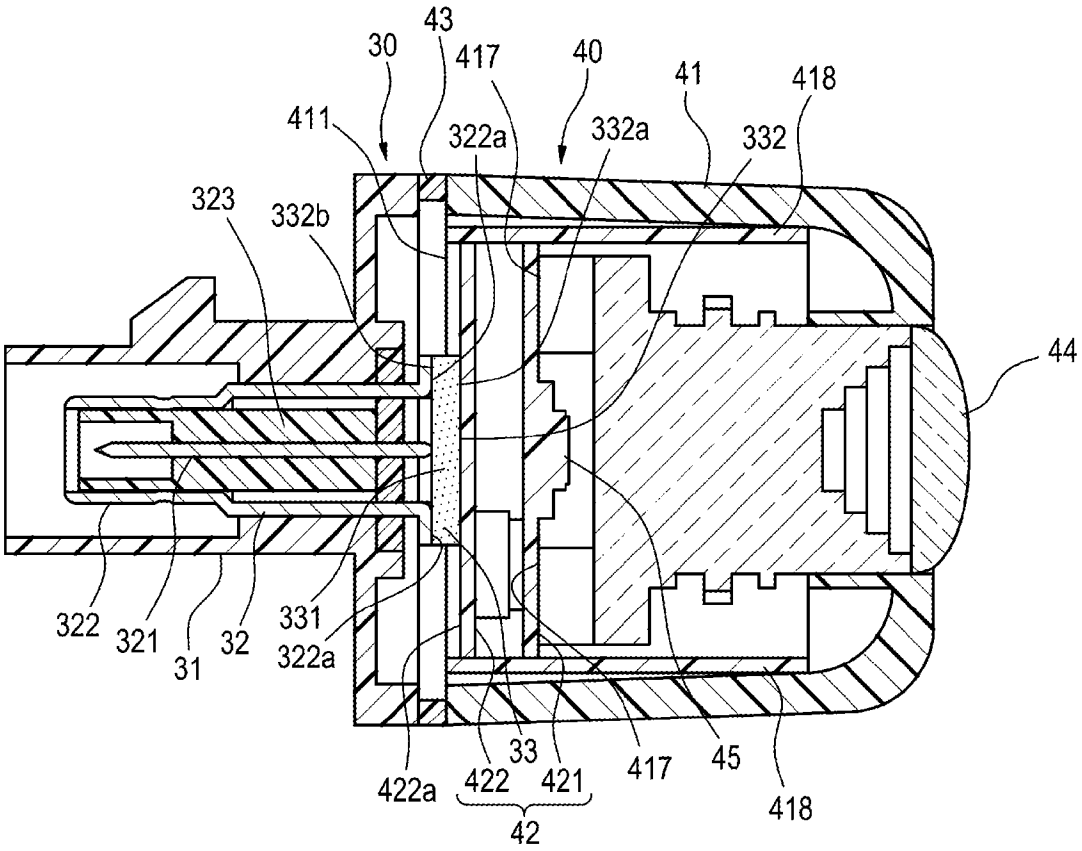
FIG. 4 is another vertical sectional view of the electronic device connector and the electronic device, illustrating a state in which the electronic device connector and the electronic device are connected to each other.

As shown in FIG. 4, in the connector 30 according to the exemplary embodiment, when the connector housing 31 is connected to the end 411 of the housing 41, the internal conductor 321 of the terminal fitting 32 and a distal end portion 322*a* of the external conductor 322 are electrically coupled to the contact portions (not shown) of the second component 45 on the circuit board 42 through the relay terminal 33.

Figure 5:
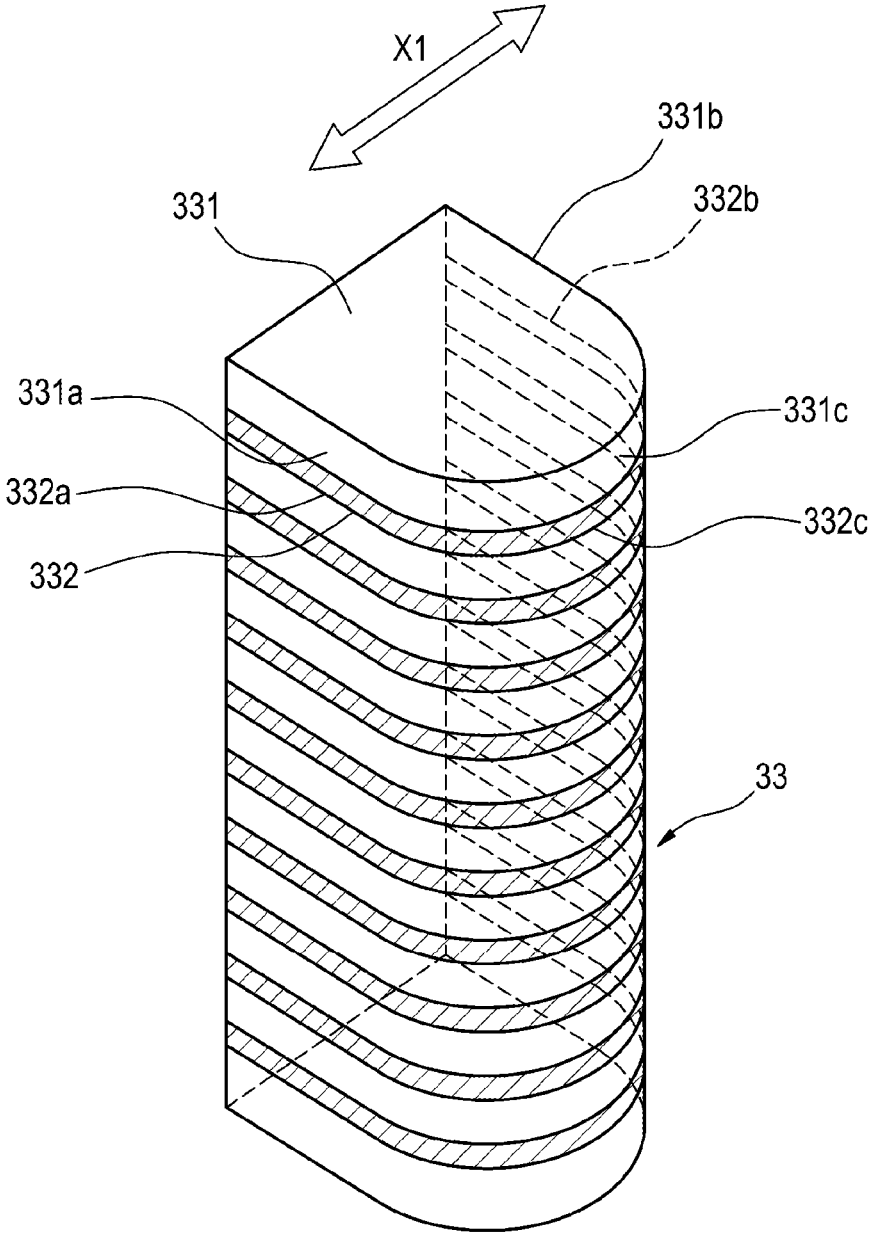
FIG. 5 is a perspective view of a relay terminal of the connector.

The relay terminal 33 is held between the distal end of the terminal fitting 32 and the contact portions of the second component 45 when the connector housing 31 is connected to the end 411 of the housing 41. As shown in FIG. 5, the relay terminal 33 includes an electrically-insulating elastic material layer 331 (an example of an electrically-insulating member) and conductive pattern layers 322 (an example of conductors) overlaid on the surface of the electrically-insulating elastic material layer 331.

Foaming sponge of an insulating resin molded into a predetermined shape is formed as the electrically-insulating elastic material layer 331. The electrically-insulating elastic material layer 331 is held between the distal end of the terminal fitting 32 and the contact portions of the second component 45 so as to be elastically deformed in the direction X1 in FIGS. 1 and 5. Thus, the electrically-insulating elastic material layer 331 biases the circuit board 42 toward the end 415 of the housing 41.

As shown in FIG. 5, the electrically-insulating elastic material layer 331 according to the exemplary embodiment has at least one lateral surface formed as a convex arc surface 331*c* smoothly connecting a surface 331*a* of the electrically-insulating elastic material layer 331 that faces the contact potion and a surface 331*b* of the electrically-insulating elastic material layer 331 that faces the terminal fitting 32 to each other.

The conductive pattern layers 332 are overlaid on the surface of the electrically-insulating elastic material layer 331 to electrically couple the contact portions on the second component 45 and the terminal fitting 32 to each other in a reliable manner The plurality of conductive pattern layers 332 forms an electrically-conductive portion.

Each of the conductive pattern layers 332 according to the exemplary embodiment includes a contact portion contacting pattern 332*a*, a terminal contacting pattern 332*b*, and an arc portion pattern 332*c*. The contact portion contacting pattern 332*a* overlaid on the surface 331*a* of the electrically-insulating elastic material layer 331 that faces the contact portion. The terminal contacting pattern 332*b* overlaid on the surface 331*b* of the electrically-insulating elastic material layer 331 that faces the terminal fitting 32. The arc portion pattern 332*c* is overlaid on the convex arc surface 331*c* to connect the contact portion contacting pattern 332*a* and the terminal contacting pattern 332*b* to each other.

A large number of the conductive pattern layers 332 are formed at a given pitch. The distal end portion 321*a* of the internal conductor 321 and the distal end portion 322*a* of the external conductor 322 are electrically coupled to the respective contact portions of the circuit board 422 through the conductive pattern layers 332. Thus, even if the distal end portion 321 a of the internal conductor 321 and the distal end portion 322*a* of the external conductor 322 are slightly displaced from the respective contact portions of the circuit board 422 in a direction perpendicular to the center axis O1 (the direction perpendicular to the up-down direction and to the surface of the sheet of FIG. 3), the distal end portion 321*a* of the internal conductor 321 and the distal end portion 322*a* of the external conductor 322 can be electrically coupled to the respective contact portions of the circuit board 422 surely through at least one conductive pattern layer 322. Accordingly, high accuracy is not required for alignment of the distal end portion 321*a* of the internal conductor 321 and the distal end portion 322*a* of the external conductor 322 with the respective contact portions of the circuit board 422, in other words, for alignment between the connector 30 and the electronic device 40. Thus, assembling work is improved.

As the relay terminal 33 according to the exemplary embodiment, for example, a GB-U type connector made by Shin-Etsu Polymer Co., Ltd. may be used.

The relay terminal 33 may be secured in position on the circuit board 422 in advance by an adhesive agent so that the relay terminal 33 does not accidentally move when attaching the connector housing 31 to the end 411 of the housing 41, thereby improving the work for connecting the connector 30 and the electronic device 40 to each other.

According to the aforementioned configuration of the connector 30 according to the exemplary embodiment, when the connector housing 31 is connected to the end 411 of the housing 41 of the electronic device 40, the relay terminal 33 is held between the terminal fitting 32 of the connector 30 and the contact portions on the circuit board 42 inside the electronic device 40 to electrically couple the terminal fitting 32 inside the connector 30 the contact portions on the circuit board 42 inside the electronic device 40 to each other through the conductive pattern layers 332 on the surface of the relay terminal 33.

With the relay terminal 33 being held between the terminal fitting 32 of the connector 30 and the contact portions on the circuit board 42 inside the electronic device 40, the electrically-insulating elastic material layer 331 is elastically deformed in a compression state so that an biasing force pressing the circuit board 42 toward the end 415 of the housing 41 is produced due to a restoring force caused by the elastic deformation. Therefore, the circuit board 42 is pressed against the board reference surface 417 of the housing 41. By the positioning performance achieved by the board reference surface 417, the center axis of the second component 45 mounted on the circuit board 42 can be positioned and aligned with the center axis of the first component 44 installed in the end 415 of the housing 41.

Accordingly, a coaxial state between the first component 44 and the second component 45 in the electronic device 40 can be obtained easily by a simple operation of connecting the connector housing 31 to the end 411 of the housing 41 of the electronic device 40.

The relay terminal includes the electrically-conductive portion having a plurality of conductors formed at the given pitch in a direction perpendicular to the center axis of the connector. At least one of the conductors electrically couples a contact portion of the terminal fitting to the contact portion of the electronic device. Accordingly, the connector and the electronic device are electrically coupled through at least one of the conductors even when they are slightly displaced from the coaxial state.

Accordingly, it is not necessary to position the connector and the electronic device coaxially with high accuracy. Thus, assembling work is improved.

In addition, according to the configuration of the connector 30 described above, a dimension error caused by an assembly error or the like can be absorbed by elastic deformation of the electrically-insulating elastic material layer 331 of the relay terminal 33 held between the terminal fitting 32 of the electronic device connector 30 and the contact portions on the circuit board 42 inside the electronic device 40 in the state in which the connector housing 31 is connected to the end 411 of the housing 41 of the electronic device 40. Therefore, the terminal fitting 32 inside the connector 30 and the contact portions of the second component 45 on the circuit board 42 can be electrically coupled to each other in a stable manner.

In addition, according to the configuration of the connector 30 described above, the relay terminal 33 is formed to include the electrically-insulating elastic material layer 331 and the conductive pattern layers 332 overlaid on the surface of the electrically-insulating elastic material layer 331. Thus, the relay terminal 33 is simple in structure and easy to manufacture. Accordingly, reduction in cost can be achieved.

In addition, according to the configuration of the connector 30 described above, the electrically-insulating elastic material layer 331 of the relay terminal 33 has at least one lateral surface formed as the convex arc surface 331*c* smoothly connecting the surface of the electrically-insulating elastic material layer 331 that faces contact portion and the surface of the electrically-insulating elastic material layer 331 that faces terminal fitting 32 to each other. Each of the conductive pattern layers 332 overlaid on the surface of the electrically-insulating elastic material layer 331 includes the contact portion contacting pattern 332*a*, the terminal contacting pattern 332*b* and the arc portion pattern 332*c*. The contact portion contacting pattern 332*a* is overlaid on the surface of the electrically-insulating elastic material layer 331 on a side of the contact portion. The terminal contacting pattern 332*b* is overlaid on the surface of the electrically-insulating elastic material layer 331 on a side of the terminal fitting 32. The arc portion pattern 332*c* is overlaid on the convex arc surface 331*c* to connect the contact portion contacting pattern 332*a* and the terminal contacting pattern 332*b* to each other.

Therefore, when the relay terminal 33 is held between the distal end of the terminal fitting 32 and the contact portions of the second component 45 to cause a change in the thickness of the electrically-insulating elastic material layer 331, each of the conductive pattern layers 332 has no acute bent portion in which stress concentration would otherwise easily occur, but the arc portion pattern 332*c* can be deformed easily. In this manner, locally extreme bending deformation can be prevented from occurring.

Therefore, even when the relay terminal 33 is elastically deformed repeatedly, fatigue hardly remains in the conductive pattern layers 332 so that it is possible to improve reliability and durability of the connection between the terminal fitting 32 inside the connector housing 31 and the contact portions of the second component 45.

Figure 6:
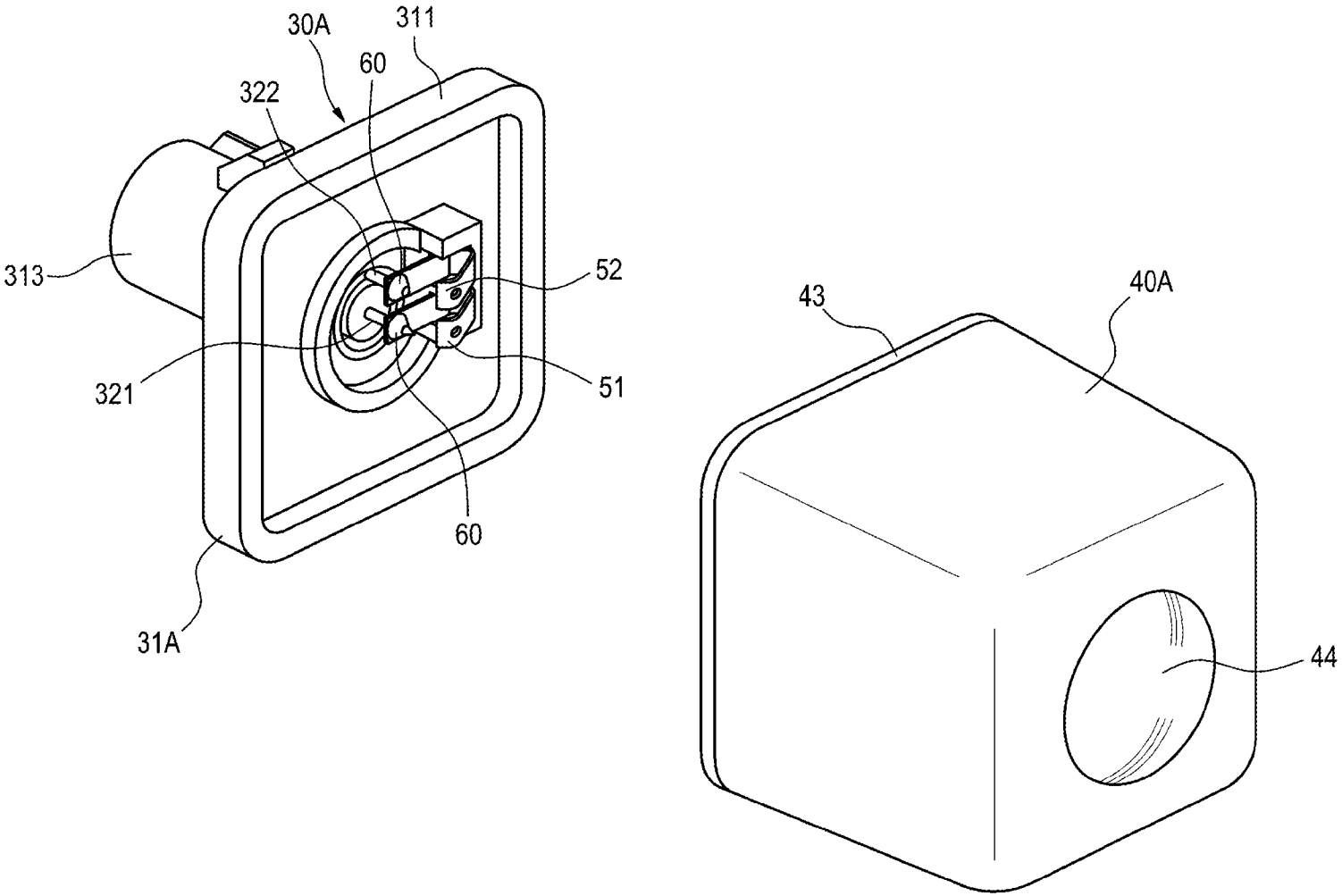
FIG. 6 is an exploded perspective view of a connector and an electronic device according to a comparative example.
Figure 7:
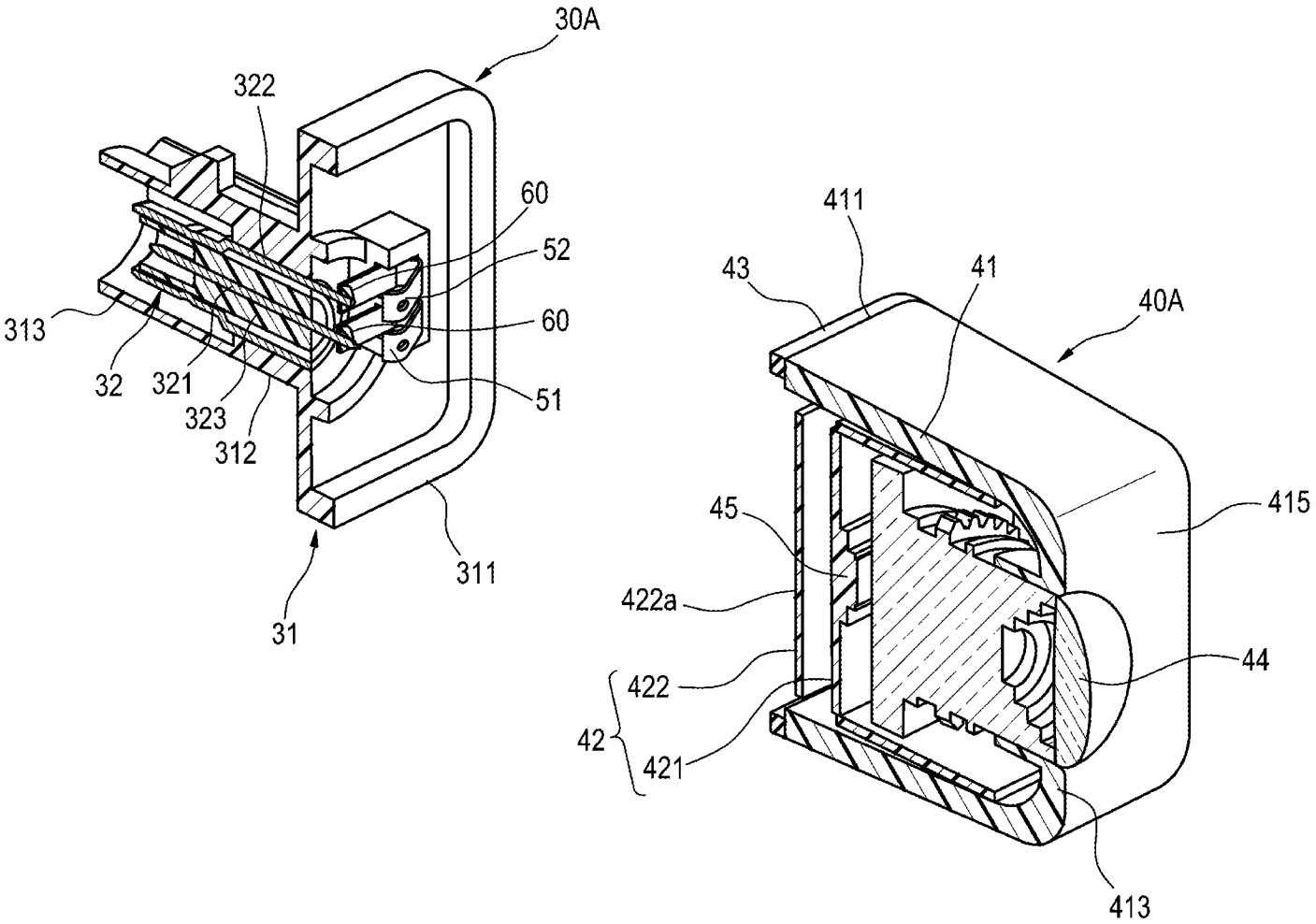
FIG. 7 is a perspective view illustrating a cross section of the electronic device connector and the electronic device shown in FIG. 6.
Figure 8:
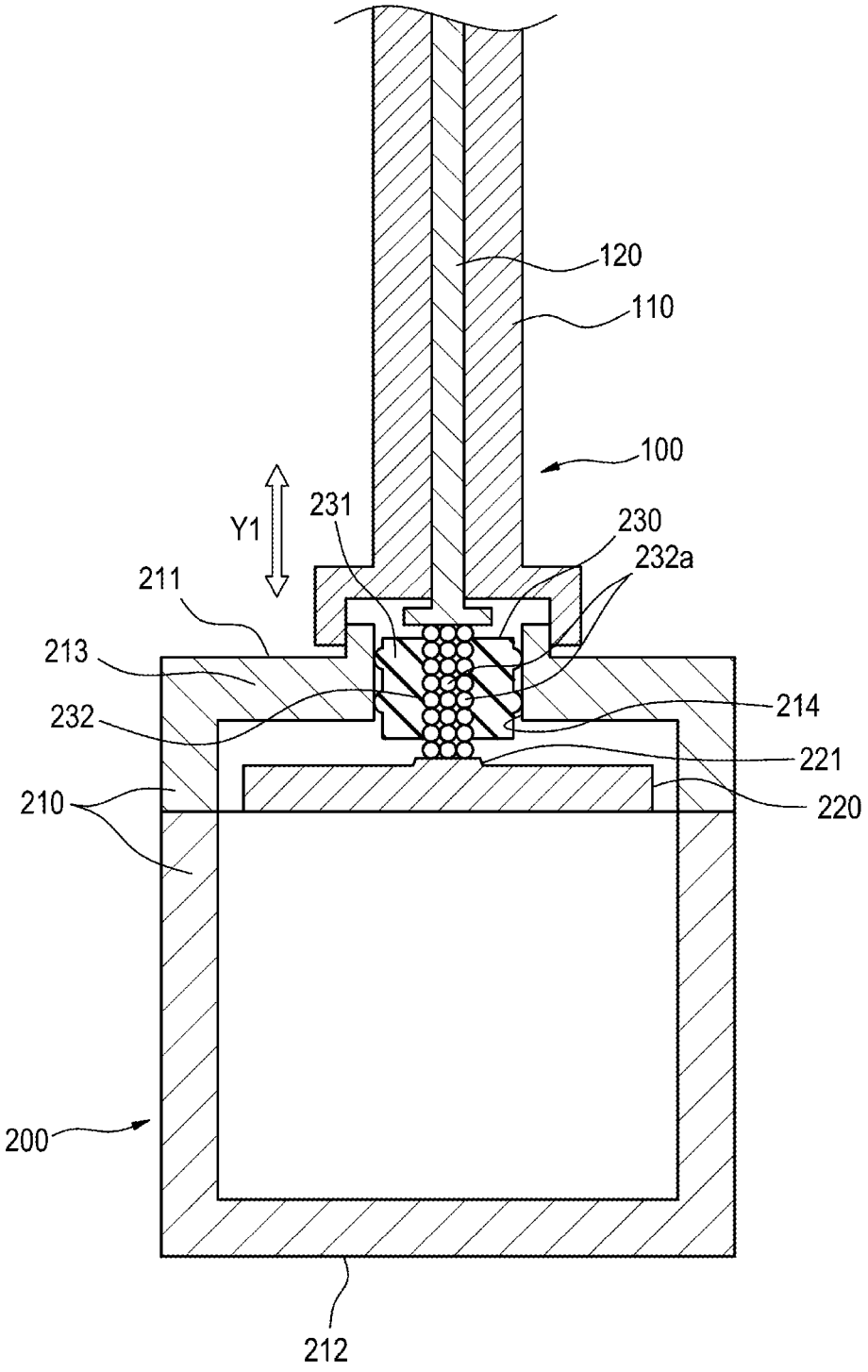
FIG. 8 is a vertical sectional view of a related art connector and an electronic device.

FIGS. 6 and 7 show a connector 30A as a comparative example. The connector 30A adapted to be connected to an end 411 of a housing 41 of an electronic device 40A (e.g., the in-vehicle camera described above). However, spring terminal fittings 51, 52 are used in place of the relay terminal 33. In addition, in the electronic device 40A, a circuit board 42 mounted with a second component 45 is fixed to the housing 41 by engagement using locking projections provided on an inner side of the housing 41.

Common elements of the connector 30A and the electronic device 40A to those of the connector 30 and the electronic device 40 according to the exemplary embodiment will be denoted by the same reference signs and description thereof will be therefore omitted.

Each of the spring terminal fittings 51, 52 is shaped like a plate spring by bending a metal plate into an L-shape. The spring terminal fittings 51, 52 are provided and fixed to distal ends of an internal conductor 321 and an external conductor 322 of a terminal fitting 32 shown in the aforementioned exemplary embodiment by solders 60.

When a flange portion 311 of the connector housing 31A of the connector 30A is connected to the end 411 of the housing 41 in the electronic device 40A, the spring terminal fittings 51, 52 make contact with contact portions of a circuit board 422 (see FIG. 7) inside the electronic device 40A in the state in which distal end portions of the spring terminal fittings 51, 52 are elastically deformed. Thus, the internal conductor 321 and the external conductor 322 inside the connector 30A are electrically coupled to the contact portions on the circuit board 422.

In the case of the comparative example, the circuit board 42 in the electronic device 40A is fixed to the housing 41 by locking projections. In this structure, there is a fear that the circuit board 42 may be positioned loosely due to a dimension tolerance or an assembly error to make it difficult to align the center axis of the second component 45 with the center axis of a first component 44.

In addition, in the configuration of the comparative example, variation may be generated easily in mounting accuracy of the spring terminal springs 51, 52 due to variation in the solders for the spring terminal terminals 51, 52. In addition, it takes time and labor in the soldering work, which makes it difficult to improve the productivity of the connector 30A.

In contrast, the problem occurring in the connector 30A can be avoided in the connector 30 according to the exemplary embodiment described above.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

For example, the relay terminal may have a configuration in which conductive pattern layers are overlaid on the surface of an electrically-insulating elastic material layer having a cylindrical body, a cross section of which being true circular, elliptical, rectangular, triangular or polygonal. Alternatively, the relay terminal may have a configuration in which a conductor is embedded in the cylindrical body having a circular, elliptical, rectangular, triangular or polygonal cross section so as to extend from one side to the other side of the cylindrical body.

With the relay terminal being deformable, it is preferable that the conductive pattern layers of the relay terminal be overlaid on a curved surface as in the exemplary embodiment described above so that the conductive pattern layers can be flexibly deformed easily without being damaged.

In addition, although the conductors of the relay terminal are formed in a direction perpendicular to the center axis in the exemplary embodiment described above, the conductors may be formed in a direction intersecting the center axis. The conductors may make contact with the contact portions not in a state where the conductors are perpendicular the center axis but in a state where the conductors are inclined to the center axis. In addition, the conductors may make contact with the contact portions in a state where the conductors are inclined on their one sides.

In addition, although the exemplary embodiment has a configuration in which the relay terminal is held between the terminal fitting of the connector and the contact portions of the electronic device, the relay terminal may be fixed to one of the electronic device and the electronic device connector.

In addition, although the plurality of conductive pattern layers of the relay terminal are formed in the exemplary embodiment described above, there may be only one conductive pattern layer when, for example, the electronic device has only one contact portion.

In addition, although the second component is an image sensor provided in the circuit board in the exemplary embodiment described above, the image sensor as the second component may not be provided on the circuit board. The image sensor may be provided inside the housing without being mounted on the circuit board.

In addition, the electronic device in which the connector according to the invention is used is not limited to an in-vehicle camera shown in the exemplary embodiment. Any electronic device may be used as long as the connector according to the exemplary embodiment can be connected to the electronic device. For example, the connector according to the exemplary embodiment may be also used in any of various electronic devices having a configuration in which the center axis of a second component on a circuit board provided on one side of a housing needs to be aligned with the center axis of a first component on the other side of the housing, or used in any electronic device having a configuration in which a second component is mounted to be inclined to a first component.

According to exemplary embodiments of the present invention, a connector (30) for an electronic device (40) is provided. The connector includes a connector housing (31) adapted to be connected to the electronic device (40), a terminal fitting (32) held by the connector housing (31), the terminal fitting (32) being electrically coupled to a contact portion of the electronic device (40) when the connector housing (31) is connected to the electronic device (40), and a relay terminal (33) adapted to be held between a distal end of the terminal fitting (32) and the contact portion of the electronic device (40) when the connector housing (31) is connected to the electronic device (40). The relay terminal (33) includes an electrically-insulating member (331) and an electrically-conductive portion. The electrically-conductive portion has a conductor (332) is provided on the electrically-insulating member (331) to electrically couple the contact portion of the electronic device (40) and the terminal fitting (32) to each other. The conductor extends in a direction intersecting a center axis of the connector (30) in a state in which the conductor is in contact with at least one of the contact portion of the electronic device (40) and the terminal fitting (32).

The direction in which the conductor (332) extends may be perpendicular to the center axis of the connector (30).

The conductor (332) may be overlaid on a surface of the electrically-insulating member (331)

The electrically-conductive portion may have a plurality of conductors (332) arranged at a given pitch in another direction intersecting the center axis of the connector (30), so that at least one of the conductors (332) electrically couples the terminal fitting (32) and the contact portion of the electronic device (40) to each other.

The electrically-insulating member (331) of the relay terminal (33) may have elasticity.

The electrically-insulating member (331) of the relay terminal (33) may have at least one lateral surface formed as a convex arc surface (331*c*) smoothly connecting a surface of the electrically-insulating member (331) that faces the contact portion and a surface of the electrically-insulating member (331) that faces the terminal fitting to each other. The electrically-conductive portion may include a contact portion contacting pattern (332*a*), a terminal contacting pattern (332*b*) and an arc portion pattern (332*c*), the contact portion contacting pattern (332*a*) being overlaid on the surface of the electrically-insulating member (331) that faces the contact portion, the terminal contacting pattern (332*b*) being overlaid on the surface of the electrically-insulating member (331) that faces the terminal fitting, and the arc portion pattern (332*c*) being overlaid on the convex arc surface (331*c*) to connect the contact portion contacting pattern (332*a*) and the terminal contacting pattern (332*b*) to each other.

The electronic device (40) may include a first component (44) provided at one end (415) of a device housing (41) and a second component (45) provided on a side of the other end (411) of the device housing (41), the second component (45) being arranged coaxially with the first component (44). The device housing (41) may have a second component reference surface (417) configured to position the second component (45) when the second component (45) is biased and pressed toward the one end of the housing (41) such that a center axis of the second component (45) is coaxially aligned with a center axis of the first component (44). The relay terminal (33) may be held between a distal end of the terminal fitting (32) and the contact portion of the second component (45) so that the relay terminal (33) is elastically deformed to bias the second component (45) toward the one end of the housing (41).

The electronic device (40) may be an in-vehicle camera.

What is claimed is:

1. A connector for an electronic device, the connector comprising:

a connector housing adapted to be connected to the electronic device;

a terminal fitting held by the connector housing, the terminal fitting being electrically coupled to a contact portion of the electronic device when the connector housing is connected to the electronic device; and a relay terminal adapted to be held between a distal end of the terminal fitting and the contact portion of the electronic device when the connector housing is connected to the electronic device, wherein the relay terminal comprises an electrically-insulating member and an electrically-conductive portion, the electrically-conductive portion comprising a conductor provided on a the electrically-insulating member to electrically couple the contact portion of the electronic device and the terminal fitting to each other, the conductor extending in a direction intersecting a center axis of the connector in a state in which the conductor is in contact with at least one of the contact portion of the electronic device and the terminal fitting.

2. The connector according to claim 1, wherein said direction in which the conductor extends is perpendicular to the center axis of the connector.

3. The connector according to claim 1, wherein the conductor is overlaid on a surface of the electrically-insulating member.

4. The connector according to claim 1, wherein the electrically-conductive portion comprises a plurality of said conductors arranged at a given pitch in another direction intersecting the center axis of the connector, and wherein at least one of the conductors electrically couples the terminal fitting and the contact portion of the electronic device to each other.

5. The connector according to claim 1, wherein the electrically-insulating member has elasticity.

6. The connector according to claim 1, wherein the electrically-insulating member has at least one lateral surface formed as a convex arc surface smoothly connecting a surface of the electrically-insulating member that faces the contact portion and a surface of the electrically-insulating member that faces the terminal fitting to each other, and wherein the electrically-conductive portion comprises a contact portion contacting pattern, a terminal contacting pattern and an arc portion pattern, the contact portion contacting pattern being overlaid on the surface of the electrically-insulating member that faces the contact portion, the terminal contacting pattern being overlaid on the surface of the electrically-insulating member that faces the terminal fitting, and the arc portion pattern being overlaid on the convex arc surface to connect the contact portion contacting pattern and the terminal contacting pattern to each other.

7. The connector according to claim 1, wherein the electronic device comprises a first component provided at one end of a device housing and a second component provided on a side of the other end of the device housing, the second component being arranged coaxially with the first component, wherein the device housing comprises a second component reference surface configured to position the second component when the second component is biased and pressed toward the one end of the device housing such that a center axis of the second component is aligned coaxially with a center axis of the first component, and wherein the relay terminal is held between a distal end of the terminal fitting and the contact portion of the second component so that the relay terminal is elastically deformed to bias the second component toward the one end of the device housing.

8. The connector according to claim 1, wherein the electronic device is an in-vehicle camera.

* * * * *